United States Patent [19]

Hunter

[11] 3,940,066

[45] Feb. 24, 1976

[54] POP-UP SPRINKLER HEAD HAVING FLOW ADJUSTMENT MEANS

[75] Inventor: Edwin J. Hunter, Rancho Santa Fe, Calif.

[73] Assignee: The Toro Company, San Marcos, Calif.

[22] Filed: Oct. 16, 1974

[21] Appl. No.: 515,218

Related U.S. Application Data

[63] Continuation-in-part of Ser. No. 487,578, July 11, 1974, abandoned.

[52] U.S. Cl. ..... 239/204; 239/582; 239/553.3; 239/575; 239/579

[51] Int. Cl.[2] ... B05B 1/16; B05B 1/30; B05B 15/10

[58] Field of Search ..... 239/203–206, 239/553, 553.3, 562, 567, 569, 575, 579, 582

[56] References Cited

UNITED STATES PATENTS

| | | | |
|---|---|---|---|
| 1,853,805 | 4/1932 | Elder | 239/205 |
| 1,892,959 | 1/1933 | Lippert | 239/204 X |
| 1,931,761 | 10/1933 | Hertel | 239/204 |
| 1,953,518 | 4/1934 | Sweetland | 239/204 |
| 2,125,978 | 8/1938 | Arbogast | 239/204 X |
| 2,763,512 | 9/1956 | Porter | 239/582 X |
| 2,796,293 | 6/1957 | Becker | 239/204 |
| 3,263,929 | 8/1966 | Seablom | 239/204 |
| 3,323,725 | 6/1967 | Hruby | 239/205 |
| 3,454,225 | 7/1969 | Hunter | 239/205 |
| 3,794,249 | 2/1974 | Lockwood | 239/582 X |

*Primary Examiner*—Robert S. Ward, Jr.

[57] ABSTRACT

A pressure control mechanism for an irrigation sprinkler having a rotatable riser with an orifice of predetermined shape with the riser sealed at the water inlet end thereof. In one embodiment, a stationary valve ring is snug-fit around the riser and circumferentially stationary with respect to the riser. The valve ring is spring biased against a shoulder on the riser at the inlet end and adapted to rise with the riser. The valve ring has an orifice which is congruent to the orifice of the riser whereby rotation of the riser with respect to the stationary valve ring regulates the flow of water through the valve orifice and the riser orifice to thereby regulate the flow of water through the sprinkler. In an alternative embodiment, a valve disc is secured to the inlet end of the riser and is circumferentially stationary with respect to the riser. The riser has a plug fixedly mounted at the inlet end and is keyed for limited rotation. Both the valve disc and the riser have orifices which are congruent whereby rotation of the riser with respect to the stationary valve disc regulates the flow of water through the valve orifice and the riser to thereby regulate the flow of water through the sprinkler.

13 Claims, 16 Drawing Figures

POP-UP SPRINKLER HEAD HAVING FLOW ADJUSTMENT MEANS

CROSS-REFERENCE TO RELATED APPLICATION

This application is a continuation-in-part of my prior co-pending, now abandoned, U.S. patent application Ser. No. 487,578 filed July 11, 1974 and assigned to the assignee of the present invention.

BACKGROUND OF THE INVENTION

The present invention relates to a pressure control device for an irrigation nozzle and more particularly to an irrigation sprinkler having a rotatable riser and a nonrotatable valve for regulating the flow and pressure of water through the sprinkler.

A number of sprinkler systems have been devised to provide proper irrigation to lawns and other seeded areas. Irrigation sprinklers may be generally classified as either fixed discharge or moving discharge sprinklers. A moving discharge sprinkler is characterized by a movable sprayhead which directs one or more water streams outwardly from the head of the sprinkler in a predetermined direction in a cyclic or oscillatory pattern to sweep over the area to be irrigated.

Moving discharge sprinklers have the advantage of low precipitation rates. They further have the ability to distribute a relatively small flow of water over a relatively large area. However, such moving sprinklers tend to be complex in construction, costly to manufacture, subject to wear and malfunction and sensitive to water flow rates and pressures. The coverage of these sprinklers is adversely affected by the wind and they are ill-suited to small and/or irregularly shaped areas. They are generally incapable of accurate trimming, that is, spraying along but not appreciably beyond the border of an irrigation area, particularly an irregular body. Accordingly, moving sprinklers are not satisfactory for all uses. In view of their necessity to rotate or oscillate, a relatively large area of movement is required.

Typical fixed discharge sprinkler systems normally have a stationary sprayhead which directs a number of discreet diverging streams of water or a generally continuous fan-shaped spray of water spreading outwardly from the spray head over a predetermined angular sweep. Fixed discharge sprinklers have the advantages of maximum simplicity, low cost, reliability, immunity to wear and the ability to irrigate small or irregular areas and to accurately trim the borders of such areas. The chief disadvantage of fixed discharge sprinklers is that they continuously deliver a relatively large flow of water to a relatively small area and thus produce a relatively high precipitation rate over the area. They are relatively inflexible with respect to varying the precipitation rate.

The problem of the characteristically inflexible operation of fixed discharge sprinklers is further compounded by the fact that they are usually operated in groups from a common control valve. These control valves are usually controlled or operated by a single manual or automatic controller which causes all of the sprinklers to deliver approximately the same amount of water to the areas surrounding the respective sprinklers. Thus, some areas which require less water are overwatered, while other areas requiring more water are underwatered.

Various prior art devices have attempted to eliminate these disadvantages of fixed discharge irrigation sprinkler heads. One particularly noteworthy device is disclosed in my prior U.S. Pat. No. 3,454,225 and assigned to the assignee of the present invention. The sprinkler disclosed in my prior patent calls for a plurality of triangularly-shaped discharge orifices and means for adjusting the spacing between the apices and base sides of the orifice to regulate the geometric shape of the spray pattern. The actual size of the nozzle orifice of this sprinkler may be adjusted by turning a center screw in the sprinkler. The radius of throw and volume of water discharged by the sprinkler can thereby be varied over a wide range.

Summary of the Invention

The present invention relates to an improvement of the sprinkler in my prior U.S. Pat. No. 3,454,225 to provide flow adjustment thereto. To attain this, the present invention provides for a rotatable hollow riser in the sprinkler having an inlet orifice of a predetermined shape and discharge orifice. Non-rotatable valve means is provided for regulating the flow and pressure of water through the sprinkler.

In one embodiment, the riser is sealed at the water inlet end by a suitable plug and a valve ring is snug-fit on the riser. The valve ring is keyed to a filter screen surrounding the riser to remain circumferentially stationary. The valve ring has an orifice which is congruent to the inlet orifice in the riser. The pressure to the entire sprinkler system is adjusted by rotating the riser either manually or by any suitable means. This provides for adjustment of the flow of water through the orifice in the valve ring and then through the inlet orifice in the riser.

In an alternative embodiment, a valve disc is secured to the inlet end of the riser and is circumferentially stationary with respect to the riser. The riser has a plug fixedly mounted at the inlet end and a key or splined stop on the surrounding filter keys the plug and riser to permit limited rotation. Both the valve disc and the riser have orifices which are congruent. Rotation of the riser with respect to the stationary valve disc regulate the flow of water through the valve orifice and the riser to thereby regulate the flow of water through the sprinkler.

In the operation of the present invention, the riser pops up in response to water pressure applied to the sprinkler system to discharge a fluid through the discharge orifices. The relative position of the riser with respect to the valve means provides flow adjustment through the hollow riser. The versatility of the system is thereby increased.

Accordingly, an object of the present invention is to provide a pop-up sprinkler head having flow adjustment means.

Another object is to provide means for adjusting the flow of water through the riser of a sprinkler system.

Still another object is to provide stationary valve means for a sprinkler system to adjust the volume or pressure of fluid through the system.

Yet another object is to provide a vastly improved bubbler head for an irrigation system to replace both the stream and gusher type bubblers.

A more complete and thorough understanding of the improvements of the pressure control mechanism of the sprinkler of the present invention will be afforded to those skilled in the art from a consideration of the following detailed explanation of the preferred embodiment of the invention, when considered in conjunction with the accompanying drawings.

DETAILED DESCRIPTION OF THE DISCLOSURE

Figure 1:
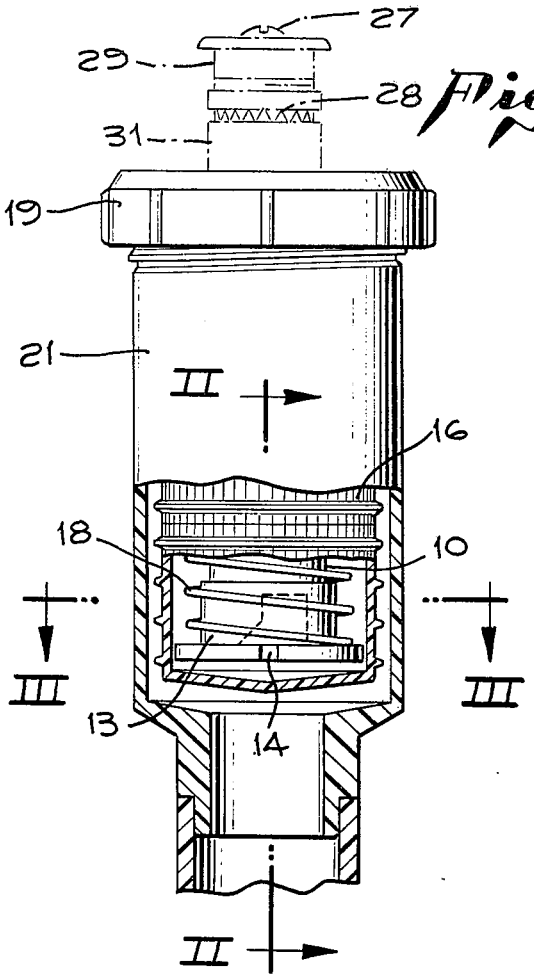
FIG. 1 is a side elevational view, partly in section, of an exemplary embodiment of the pressure control apparatus according to the present invention.

In the embodiment of the present invention shown in FIGS. 1 through 11, there is shown the pressure control mechanism of the present invention having riser means 10 having an orifice 11 for receiving fluid under pressure and flow control means in the form of valve means 13 for adjusting the flow of fluid through the riser means 10.

The riser means 10 in the preferred embodiment is mounted in a generally cylindrical housing 21 and has a generally tubular shape for receiving water under pressure. The riser has a plug 12 at the bottom for sealing the riser and forming the perimeter of one edge of the orifice.

Figure 3:
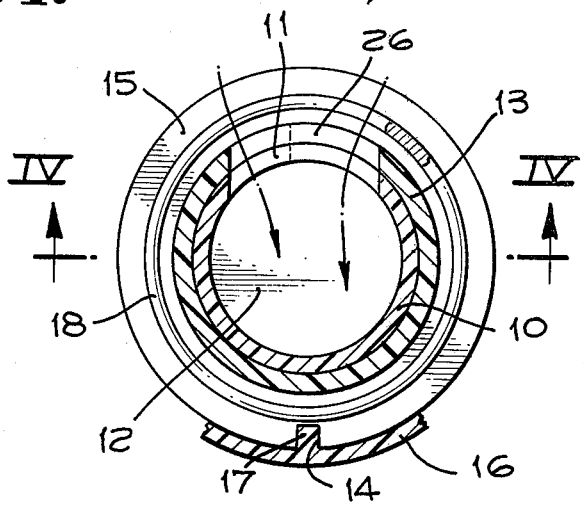
FIG. 3 is a horizontal cross-sectional detail view of the apparatus of FIG. 1 taken along the plane III—III.

Valve means 13 is circumferentially fitted around the riser 10 and adapted to adjust the flow of fluid through the riser 10. The valve means 13 is preferably formed of a cylindrical ring having a key slot 14 which engages a key 17 of a filter screen 16 as shown in greater detail in FIG. 2. As shown in FIG. 3, the key 17 of the filter screen 16 prevents the valve ring 13 from rotating in a horizontal plane. A spring 18 urges the valve ring 13 in abutting relationship with the shoulder 20 of the riser 10. The top of spring 18 is urged against cap 19 of the cylindrical housing 21. The valve ring thereby moves linearly in the vertical direction, abutting against the riser, acting as a seat for spring 18.

Figure 10:
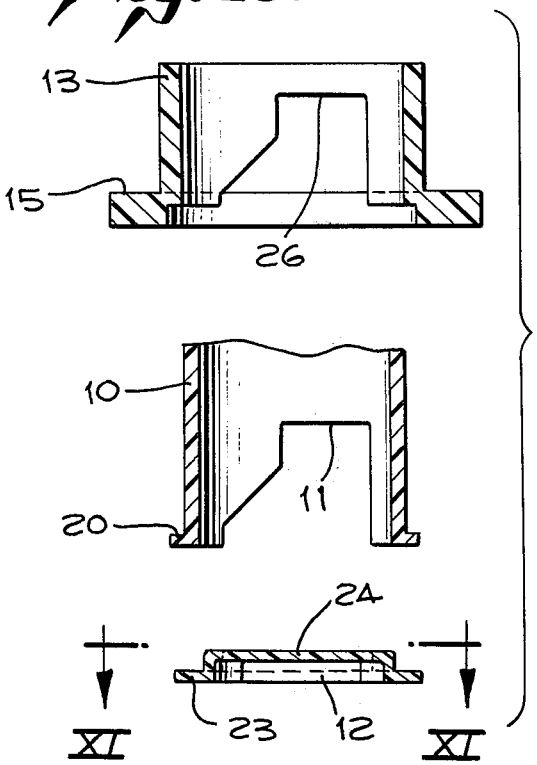
FIG. 10 is a vertical exploded view of the plug, riser and valve ring of the present invention.
Figure 11:
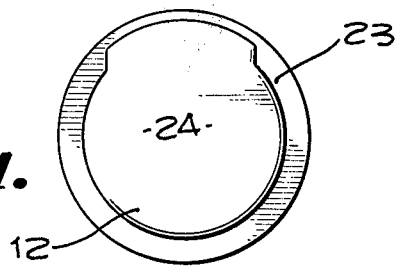
FIG. 11 is a horizontal view of the plug of FIG. 10.

The plug 12 has a lip 23 and a protrusion 24 which seals the riser 10 at the bottom and along the lower edge of the riser as shown in FIGS. 10 and 11. The riser orifice 11 is thereby sealed at the bottom by the plug 12. The valve ring 13 has an orifice 26 which is congruent to the orifice 11 of the riser 10. The flow of fluid into the hollow riser may be adjusted by adjusting the position of the valve orifice 26 with respect to the position of the riser 11. This adjustment may be obtained by rotating the riser 10. Since the key 17 of the filter screen 16 retains the valve ring 13 stationary in a horizontal position, the relative position of orifice 11 with respect to that of orifice 26 may be controlled by simply rotating the riser 13 by any suitable means.

Discharge means are shown in FIG. 1 for adjusting the geometric shape of the pattern of fluid which flows through the discharge end of riser 10. The discharge means are in the form of orifices 28 which may be formed in geometric configuration to cause the discharge spray to have any desired geometric shape. For example, the discharge orifices may be formed of generally triangular exit sections, each bound by converging sides defining an apex and a base side opposite the apex as shown in greater detail in my previous U.S. Pat. No. 3,454,225. The spacing between the apices and base sides of the discharge orifices may be varied by rotating an upper section 29 of the riser 10 with respect to a lower section 31 of the riser 10. This effectively varies the areas of the discharge orifices without altering their geometric proportions.

The cylindrical housing 21 has an inlet port 22 into which fluid is transmitted. In the passive state, the spring 18 abuts against shoulder 15 of the valve ring 13 to urge the riser 10 downwardly to be completely surrounded circumferentially by the housing 21. Fluid pressure transmitted from the inlet port 22 urges the riser 10 upwardly against the bias of spring 18 as shown in phantom in the upper portion of FIG. 1. The fluid is transmitted through orifice 26 of the valve ring 13, through orifice 11 of the riser 10 and upwardly through the hollow center of riser 10. The fluid is then discharged through the discharge orifices 28 formed at the top of the riser 10. The construction of the valve ring 13 formed at the inlet end of the riser thereby controls the flow of fluid through the hollow riser. The discharge orifices formed at the discharge end of the riser control the area of coverage of the fluid discharged from the riser. The flow control feature provided by the valve ring and orifice construction thereby enhances the versatility of the sprinkler system.

Figure 4:
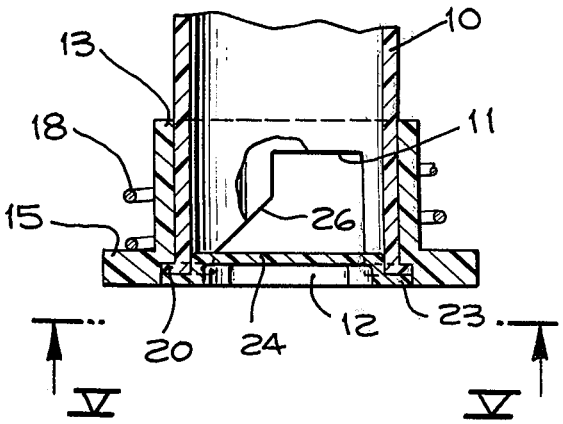
FIG. 4 is a vertical cross-sectional view of the pressure control mechanism of the present invention with the valve means completely open as shown in FIG. 3 taken therein along the plane IV—IV.
Figure 2:
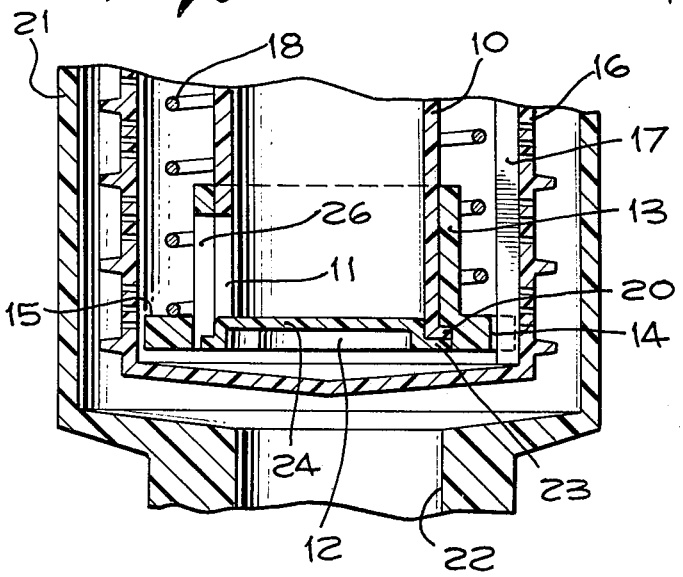
FIG. 2 is a detailed view of the pressure control apparatus of FIG. 1 taken along the plane of II—II.
Figure 5:
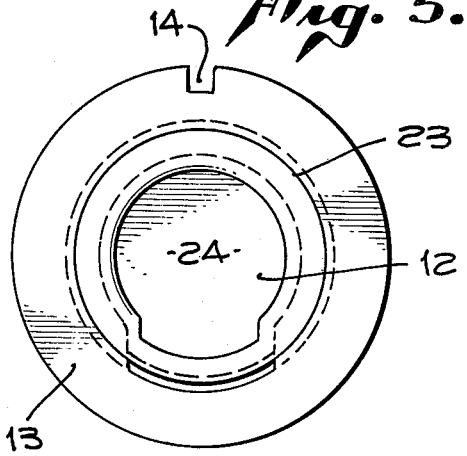
FIG. 5 is a horizontal cross-sectional view of the apparatus of FIG. 4 taken therein along the plane V—V.

Illustrative relative positions of the riser 10 with respect to the valve ring 13 are shown in FIGS. 3 through 9. As shown in FIGS. 3, 4 and 5, the riser 10 is adjusted to an angular position to render the riser orifice 11 flush with the valve ring orifice 26. This relative positioning provides maximum pressure of fluid through the nozzle apparatus.

Figure 6:
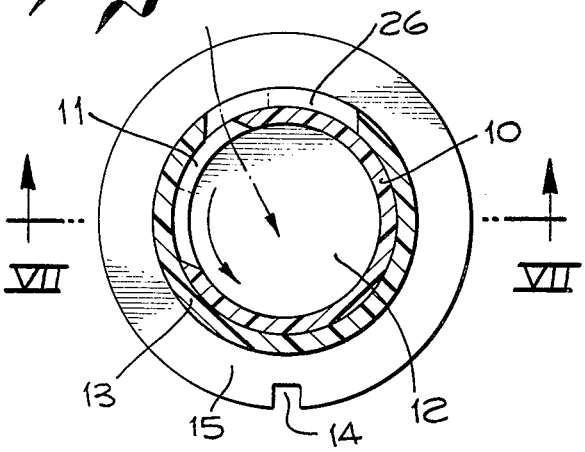
FIG. 6 is a horizontal cross-sectional view of the pressure control mechanism of the present invention in partially opened position.
Figure 7:
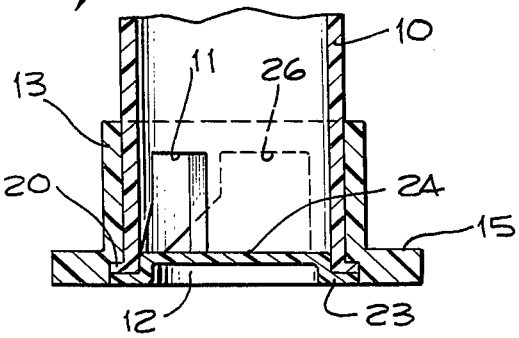
FIG. 7 is a vertical cross-sectional view of the pressure control mechanism of the present invention with the valve means partially open as shown in FIG. 6 taken along the plane VII—VII.

As shown in FIGS. 6 and 7, the riser 10 may be rotated to render the riser orifice 11 only partly flush with the valve ring orifice 26. The effective opening between the valve ring 13 and the inside of the riser 10 is thereby reduced and the flow of fluid through the passageway is correspondingly diminished. The pressure of fluid through the nozzle is accordingly reduced.

Figure 9:
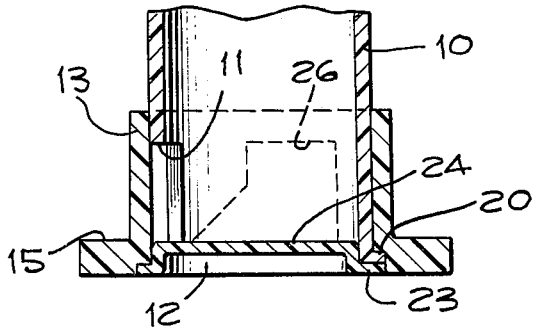
FIG. 9 is a vertical cross-sectional view of the pressure control mechanism of the present invention with the valve means completely closed as shown in FIG. 8 taken along the plane IX—IX.
Figure 8:
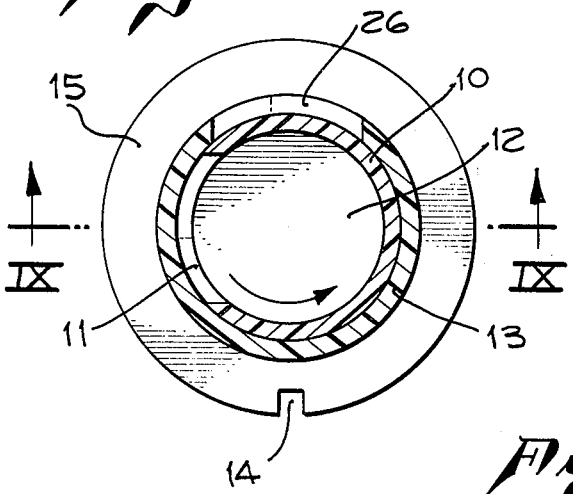
FIG. 8 is a horizontal cross-sectional view of the pressure control mechanism of the present invention in the completely closed position.

The riser 10 may be further rotated to completely impede the flow of fluid. As shown in FIGS. 8 and 9, the riser 10 is rotated to render the riser orifice 11 completely out of communication with the valve ring orifice 26. The flow of water through the hollow riser may thereby be completely turned off by this rotation of the riser.

It is noteworthy that the orifice 11 of the riser is shown to have a composite rectangular and triangular portion. Similarly, the orifice 26 of the valve ring 13 has a substantially congruent shape to that of orifice 11 as shown in FIG. 10. Orifice 11, however, may be formed in any suitable shape and need not necessarily be congruent with orifice 26. In fact, the riser 10 may have a plurality of orifices distributed circumferentially therearound and the valve ring 13 may also have a plurality of orifices distributed circumferentially therearound. The orifice on the riser 10 need not necessarily be congruent with that of the valve ring 13.

In the alternative embodiment shown in FIGS. 12 through 16, there is shown the pressure control mechanism of the present invention having riser means 40 having a plug 41 with an orifice 47. The plug 41 is fixedly mounted at the inlet end thereof and has an arcuate indentation or cut-out portion as shown. The flange 40' of the riser is formed with an arcuate cut-out portion which is in mating configuration with that of the plug. A key or stop spline 42 is formed on the filter screen 43 to key the plug 41 and riser 40 to permit rotation thereof between the shoulders at the extremities of the arcuate cut-out portions.

Figure 14:
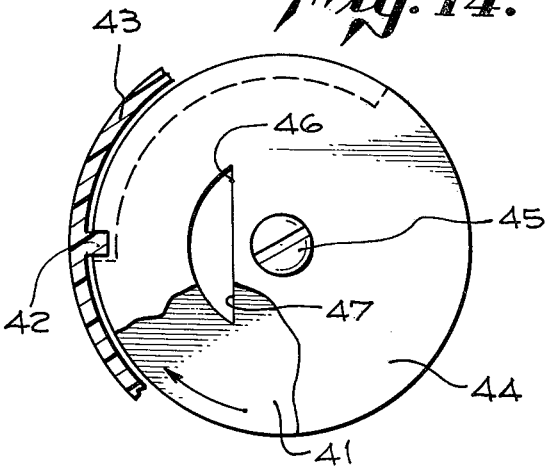
FIG. 14 is a horizontal cross-sectional detail view of the apparatus of FIG. 13 taken along the plane XIV—XIV with the valve means open.
Figure 15:
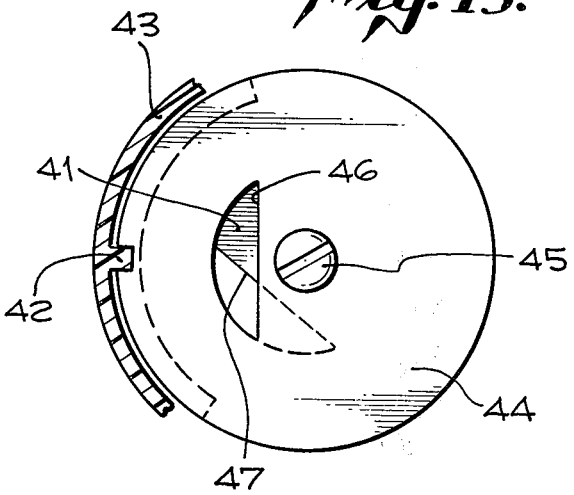
FIG. 15 is a horizontal cross-sectional detail view of the apparatus of FIG. 13 taken along the plane XIV—XIV with the valve means partially open.
Figure 13:
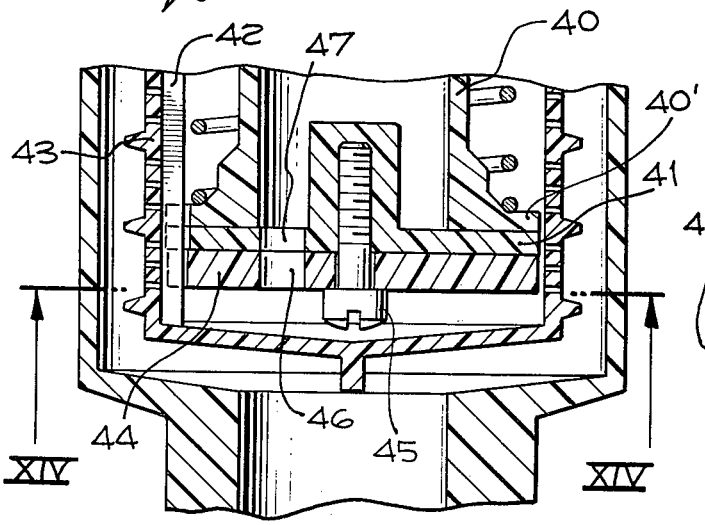
FIG. 13 is a detailed view of the pressure control apparatus of FIG. 12.
Figure 16:
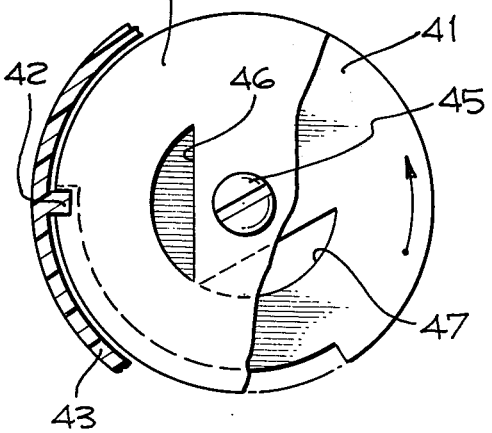
FIG. 16 is a horizontal cross-sectional detail view of the apparatus of FIG. 13 taken along the plane XIV—XIV with the valve means closed.

In this embodiment, flow control means is provided by valve means in the form of an arcuate apertured disc 44. The valve disc 44 is rotatably secured to the riser adjacent the plug means at the inlet end by a screw 45 and has an orifice 48 which is congruent to the orifice 47 of the plug 41. As shown in FIGS. 14, 15, and 16, the valve disc 44 is keyed to the stop spline or key 42 to be circumferentially stationary with respect to the riser 40.

Figure 12:
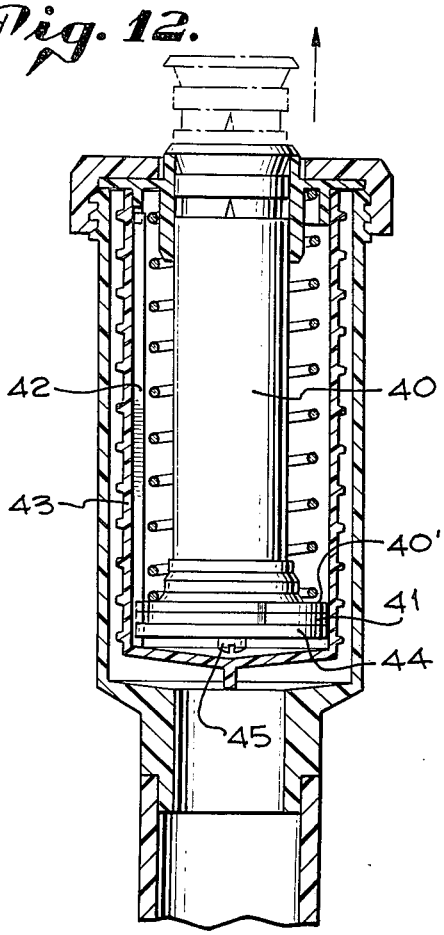
FIG. 12 is a side elevational view, partly in section, of an alternative embodiment of the pressure control apparatus according to the present invention.

In the operation of this embodiment of the present invention, the pressure from the fluid applied to the riser causes it to rise as shown in phantom in FIG. 12. The fluid is transmitted through the orifice 46 of the valve disc 44, through the orifice 47 of the plug 41 and upwardly through the hollow center of riser 40. The fluid is then discharged through discharge orifices formed at the top of the riser 40.

The valve disc 44 provides adjustability of the flow of fluid through the hollow riser 40 as shown in FIGS. 14, 15 and 16. In FIG. 14, the riser 40 and plug 41 are rotated so that the orifice 46 of the valve disc 44 is fully aligned or flush with the orifice 47 of the plug 41. This provides for a maximum flow of fluid through the riser 40. In FIG. 15, the riser 40 and plug 41 are shown as being rotated so that only part of the orifice 46 is aligned or flush with the orifice 47. This provides for a reduced flow of fluid through the riser 40 and out the discharge orifices of the riser 40 at the top. In FIG. 16, the riser 40 is shown rotated so that the orifice 46 is completely out of communication with orifice 47. This completely impedes the flow of fluid through the system. The rotation of riser 40 relative to the valve disc 44 thereby controls the flow of fluid through the hollow riser 40.

It is, therefore, apparent that the construction of the present invention provides greater versatility in adjusting the pressure and fluid flow through the nozzle apparatus. The nozzle thereby becomes a highly improved bubbler head which may replace both the stream and gusher type of bubblers. The components are preferably molded of any suitable plastic. They are therefore easily constructed and the system may be easily assembled.

Obviously, many modifications and variations of the present invention are possible in light of the above teachings. For example, although the present system is primarily designed for water irrigation systems, it may be used for any fluid dispersing application. It is, therefore, to be understood that within the scope of the appended claims, the invention can be practiced otherwise than as specifically described.

I claim:

1. In an improved versatility sprinkler for varying the flow rate of fluid through a sprinkler head having a housing for receiving water under pressure and riser means mounted therein, said riser means having an inlet end within said housing and a discharge end, exteriorly of said housing, the improvement comprising:

first means formed at the discharge end of said riser means for adjusting the area of coverage of the fluid discharged from said riser means; and second means associated with the inlet end of said riser means within said housing for adjusting the rate of flow of fluid from said housing into said riser in response to rotational movement of said riser means relative to said housing independently of the adjustment of said first means whereby the area of coverage of the fluid discharged from the riser means may be independently adjustable through manipulation of said first means and the flow rate of fluid discharged into the selected area of coverage is independently adjustable exteriorly of said housing through manipulation of the discharge end of said riser means.

2. In a sprinkler head construction having a housing adapted to be connected to a source of water under pressure, a riser means mounted to said housing with an inlet end within the housing and an outlet end exteriorly of the housing and means formed at the discharge end of said riser means for adjusting, exteriorly of the housing, the area of coverage of the water discharged, the improvement comprising the provision of:

valve means associated with the inlet end of said riser means within said housing for adjusting the rate of flow of water from said housing into said riser means in response to rotational adjustment, from the exterior of said housing, of said riser means independently of the adjustment of said means formed at the discharge end of said riser means.

3. The improvement in sprinkler head construction of claim 2 wherein said riser means comprises a vertically oriented tubular member having an inlet orifice formed at the inlet end thereof; and said valve means comprises a cylindrical valve member mounted about the inlet end of said tubular member in a relatively rotatable relationship with a valve orifice formed in a side wall thereof, said cylindrical valve member being mounted for non-rotational movement relative to said housing, whereby rotational movement of said valve means tubular member relative to said housing provides adjustable positioning of said riser inlet orifice and valve orifice to control the flow rate of fluid discharged from said riser means.

4. The improvement in sprinkler head construction of claim 2 wherein limit stop means are provided for limiting the rotational movement of said riser means relative to said valve means.

5. The improvement in sprinkler head construction of claim 3 wherein:

said riser means comprises a vertically oriented tubular member having a ported plug means in the inlet end thereof, said ported plug means providing a riser inlet orifice; and said valve means includes an apertured disc rotatably mounted to said riser means overlying said plug means, said apertured disc providing said valve orifice.

6. A sprinkler head including a housing having a water inlet and an outlet comprising:

riser means associated with said housing and including an upper discharge end protruding through said housing outlet and a lower water inlet end having a riser inlet orifice for receiving water from within said housing and directing it out through said discharge end exteriorly of said housing, said riser means being mounted to said housing for relative rotation thereto; and valve means within said housing and inlcuding a valve orifice adjustably registerable with said riser inlet orifice upon relative rotation between said riser means and valve means for controlling the flow of water from said housing into said riser, said valve means being non-rotatably mounted to said housing whereby the flow rate of water emitted through said riser means may be adjusted exteriorly of said housing by manual rotational adjustment of said protruding riser discharge end relative to said housing and valve means.

7. The sprinkler head of claim 6 wherein:

said riser means comprises a vertically oriented tubular member having said riser inlet orifice formed in a lower side wall portion thereof; and said valve means comprises a cylindrical valve member mounted about the lower end of said tubular member in a relatively rotatable snug-fit and said valve orifice is formed in a side wall thereof to be adjustably registerable relative to said riser inlet orifice upon relative rotation of said tubular member to said valve member.

8. The sprinkler head of claim 7 wherein:

said valve means cylindrical valve member is mounted to said riser means tubular member for vertical movement therewith and vertically oriented key and slot means are provided between said cylindrical valve member and a stationary member associated with said housing to retain said valve member stationary about its vertical axis upon rotation of said riser means tubular member.

9. The sprinkler head of claim 6 wherein:

limit stop means are provided for limiting the rotational movement of said riser means relative to said valve means.

10. The sprinkler head of claim 9 wherein said limit stop means comprises the provision of an arcuate cut-out portion on said riser means tubular member with stop shoulders at opposite ends thereof and a stationary key member associated with said housing.

11. The sprinkler head of claim 7 wherein said riser means inlet orifice has a substantially triangular side cut-out portion thereof and said valve means valve orifice has a substantially vertically straight side wall for adjustable registry with said triangular cut-out portion of said riser inlet orifice to provide a triangular inlet of adjustable size to said riser means within said housing.

12. The sprinkler head of claim 6 whrein:

said riser means comprises a vertically oriented tubular member having a ported plug means in the bottom end thereof providing said riser inlet orifice; and said valve means includes an apertured disc rotatably mounted to said riser means overlying said plug means and providing said valve orifice.

13. The sprinkler head of claim 6 wherein:

means are associated with said discharge end of said riser means for adjusting the area of coverage of the fluid discharged from said riser means independently of the adjustability of the flow rate of water emitted therefrom.

* * * * *